United States Patent [19]

Takata et al.

[11] 4,207,807

[45] Jun. 17, 1980

[54] PLASTIC AIR CYLINDER ASSEMBLY

[75] Inventors: Yataro Takata, Fujisawa; Yukinori Takenoshita, Ebina; Kiyoshi Sasahara; Akira Shigaki, both of Fujisawa; Kazuo Hirai, Kamakura; Kosei Maeda, Yokohama; Hideo Tadokuro, Sagamihara; Hirokazu Maeda, Yamato, all of Japan

[73] Assignee: Oiles Industry Co., Ltd., Tokyo, Japan

[21] Appl. No.: 938,435

[22] Filed: Aug. 31, 1978

Related U.S. Application Data

[63] Continuation-in-part of Ser. No. 718,020, Aug. 26, 1976, abandoned.

[30] Foreign Application Priority Data

| | | | |
|---|---|---|---|
| Sep. 4, 1975 | [JP] | Japan | 50-121276[U] |
| Feb. 17, 1976 | [JP] | Japan | 51-16729[U] |
| Feb. 18, 1976 | [JP] | Japan | 51-15790[U] |

[51] Int. Cl.[2] ..... F01B 29/00

[52] U.S. Cl. ..... 92/128; 92/83; 92/159; 92/170; 403/30

[58] Field of Search ..... 92/85 A, 170, 243, 155, 92/158, 159, 171, 169, 83, 86, 86.5, 156, 128; 277/24, 59; 403/29, 30, 336, 337; 285/187

[56] References Cited

U.S. PATENT DOCUMENTS

| | | | |
|---|---|---|---|
| 3,040,712 | 6/1962 | Harrah | 92/170 |
| 3,187,960 | 6/1965 | Gorman | 92/170 |
| 3,559,539 | 2/1971 | Nagy | 92/128 |
| 3,703,125 | 11/1972 | Paulivkonis | 92/170 |
| 3,738,232 | 6/1973 | Kado | 92/169 |
| 4,055,107 | 10/1977 | Bartley | 92/86.5 |

FOREIGN PATENT DOCUMENTS

| | | | |
|---|---|---|---|
| 2245627 | 3/1974 | Fed. Rep. of Germany | 92/170 |
| 780615 | 10/1934 | France . | |

*Primary Examiner*—Abraham Hershkovitz

[57] ABSTRACT

A plastic air cylinder assembled by the specific combination of a plurality of metal tie rods, inside and outside nuts, a resilient and compressible member and supporting plates whereby the plastic cylinder tube is permitted to expand more than the metal tie rods.

6 Claims, 8 Drawing Figures

PLASTIC AIR CYLINDER ASSEMBLY

This application is a continuation-in-part of our copending application Ser. No. 718,020 filed Aug. 26, 1976 now abandoned.

This invention relates to an improved plastic air-cylinder assembly of the type including a piston-rod unit movable within a plastic cylinder tube having head and rod covers, and used as a pneumatic linear actuator.

In the prior art, a variety of plastic air cylinder assemblies of this type are proposed.

For more practically using a plastic air cylinder assembly of this type, the following some problems are raised to be solved in this technical field:

A plastic air cylinder assembly of this type is used without oil feeding i.e. without provision of any oil feeding apparatus e.g. an oiler which is indispensable in a metal cylinder. However, the friction resistance between a cylinder tube in operation without oil feeding and a piston packing sladable relative to the tube is considerably large, and the packing is inevitably worn out rapidly, so that satisfactory work efficiency cannot be achieved.

Therefore, one of the problems to be solved consists of the improvement in the friction resisting property of a plastic air-cylinder assembly of the above-mentioned type.

In a conventional air cylinder assembly of the said type, a cylinder tube and covers are combined together by threaded engagement or by tightly fixing with a tie rod.

These methods are suitably selected depending on the inner diameter of the cylinder tube, e.g. the threaded engagement is adopted for a cylinder tube of smaller inner diameter, and tie rod fixing for one of larger inner diameter.

In an air cylinder assembly in which a plastic tube and covers are combined in the latter method i.e. tightly fixed together with a metal tie rod, there occur inevitably extraordinary stress and expansion in the tube on account of the expansion of the plastic cylinder tube with respect to the metal tie-rod due to different coefficients of thermal expansion and contraction between the plastic and metal materials, or loosening of the fixed cylinder assembly on account of the contraction of the tube relative to the metal tie rod.

Therefore, another problem to be solved consists in the improvement of the connetion between components of the plastic air cylinder assembly of the said type.

A cylinder tube for a plastic air-cylinder assembly is preferably formed of satisfactorily self-lubricating plastic material.

As such self-lubricating plastic materials, there are polyacetal resin, polycarbonate resin, polyethylene resin, polypropylene resin, polyamide resin and the like. However, polyethylene resin and polypropylene resin swell when used with a lubricating agent e.g. grease to be applied during setting up of a cylinder, and polyamide resin absorbs water in the air when used with air as working fluid, disadvantageously to change the size of the cylinder tube in use and thereby fail in achieving satisfactory working efficiency.

Further, polyacetal resin and polycarbonate resin are free from any of the abovementioned influence by lubricating agent and water, unlike polyethylene resin, polypropylene resin and polyamide resin, and having an excellent self-lubricating property, but they have a low elongation property. Therefore, in a cylinder assembly having a cylinder tube formed of these resins, when an impact load is accidentally placed from outside on the tube in operation, if air is used as driving fluid, unlike the case of using hydrauric pressure e.g. of water, oil or the like, the explosive cubical expansion of air causes the tube to burst with a roar, to scatter fine broken pieces around, dangerously.

Such a danger is unavoidable especially in a cylinder tube of a large inner diameter, because the maximum thickness of the tube is limited in view of dimensional stability.

Consequently, another problem to be solved lies in the avoidance of the danger of scattering around of fine pieces of the tube accompanied by the bursting of the tube in a plastic air cylinder assembly of the said type including a cylinder tube formed from polyacetal or polycarbonate resin and having a large inner diameter.

A further problem to be solved lies in more effectively preventing a piston from strike the cover with great shock at its stroke end.

Therefore, one object of the present invention is to provide a plastic air cylinder assembly of the said type in which friction resistance is remarkably reduced by providing a structure for the storage of a lubricant e.g. grease on the outside of a plastic piston.

Another object of the present invention is to provide a plastic air cylinder assembly the stability against heat change of which is remarkably improved by tightly securing a plastic tube and covers with a metal tie rod having resilient elements so that piston-rod unit is included in the tube and covers so as to be movable longitudinally of the cylinder tube.

A further object of the present invention is to provide a plastic air cylinder assembly in which danger due to the bursting of the tube is eliminated by providing on the outer circumferential surface of a large-diametered cylinder tube formed from polyacetal or polycarbonate resin a protective layer of a plastics of higher extensibility than that of polyacetal or polycarbonate resin.

A further object of the present invention is to provide a plastic air cylinder assembly in which the shock of a piston to covers at its stroke end is effectively reduced by providing in a cylinder a cushioning mechanism in which the resiliency of a resilient member cooperates with that of air.

Other objects, advantages and applications of the present invention will become apparent from the following detailed description of a preferred embodiment thereof given with reference to the appended drawings, in which.

Figure 1:
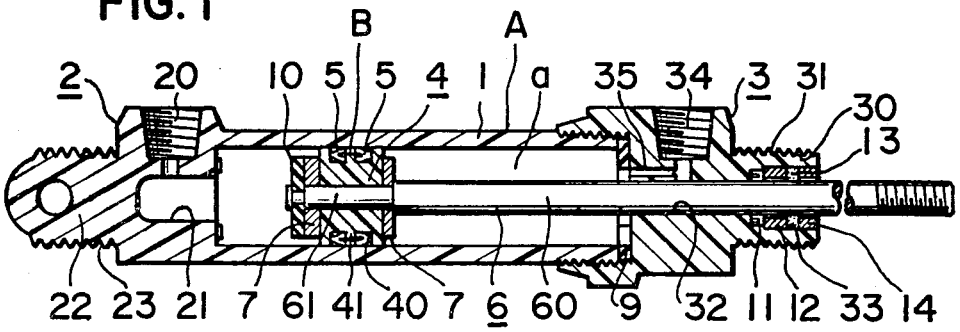
FIG. 1 is a longitudinal sectional view of a preferred embodiment of a plastic air cylinder assembly according to the present invention.

In the drawings is shown a cylinder tube (1) formed from thermoplastic synthetic resin selected from a group consisting polyacetal resin, polycarbonate resin or oleo-synthetic resin containing these resins and a lubricant dispersed therein.

If the cylinder tube 1 is formed from oleo-synthetic resin containing a lubricant in dispersion, the inner wall surface of the cylinder tube has a lubricating coat thereon, being effective for the sliding movement of the piston packing mentioned below relative to the tube especially at the time of starting the operation.

Such an oleo-synthetic resin is preferably oil containing polyacetal resin prepared by a method disclosed in U.S. Pat. No. 3,850,821.

In polyacetal resin prepared by this method, lubricant is uniformly dispersed as separate fine particles in the resin.

That is, polyacetal resin prepared by the method disclosed in U.S. Pat. No. 3,850,821, contains in the resin lubricants such as minerals oils e.g. #30 engine oil and #120 cylinder oil, other synthetic lubricant, lubricant which is solid at the normal temperature e.g. hydrocarbon and wax, solid lubricant e.g. black lead or molybdenum disulfide which is used in combination with the abovementioned lubricant, said lubricant being uniformly dispersed as separate fine particles. Therefore, the sliding surface of a sliding member formed from this resin is always provided with lubricant, thus achieving always excellent sliding movement.

Numeral 2 indicates a head cover disposed at one end of the cylinder tube 1, and numeral 3 a rod cover at the other end of the tube 1.

The cylinder tube 1, the head cover 2 and the rod cover 3 are assembled into a cylinder in a manner suitably selected depending upon the dimension of the inner diameter of the tube 1.

That is, in case of a cylinder tube of a smaller inner diameter, the cylinder tube 1 and the head cover 2 or the rod cover 3 are integrally injection molded, and a separately molded other cover is threadedly secured to the other end of the cylinder tube 1. On the other hand, in case of a cylinder tube having a larger inner diameter, the cylinder tube 1, the head cover 2 and the rod cover 3 are separately molded and then they are secured together by means of a tie rod.

FIG. 1 illustrates an embodiment of an assembly of the present invention in which the cylinder tube 1 and the head cover 2 are integrally molded, and the separately molded rod cover 3 is threadedly secured to the other end of the cylinder tube 1.

Figure 2:
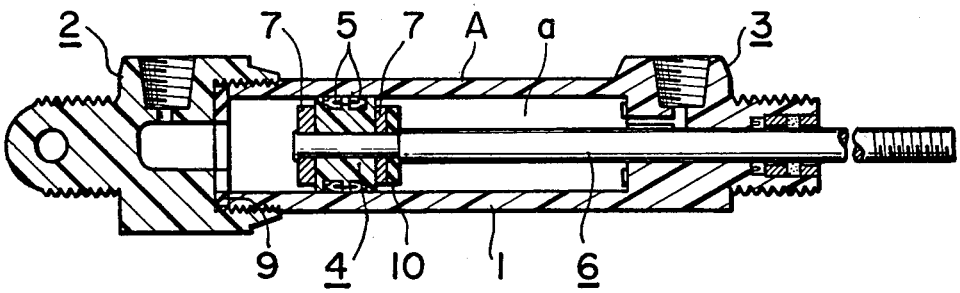
FIG. 2 is a longitudinal sectional view of another preferred embodiment of a plastic air cylinder assembly according to the present invention.

FIG. 2 illustrates another embodiment of an assembly according to the present invention, in which the cylinder tube 1 and the rod cover 3 are integrally molded, and the separately molded head cover 2 is threadedly secured to the other end of the cylinder tube.

The cylinder body A comprises the cylinder tube 1, the head cover 2 and the rod cover 3, and a cylinder chamber a is defined inside the cylinder body.

Numeral 4 indicates a plastic piston provided inside the cylinder chamber a.

Figure 5:
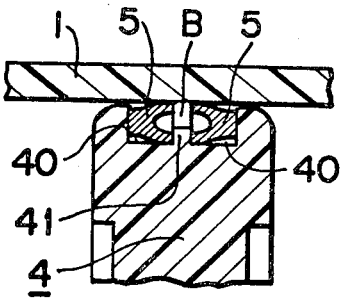
FIG. 5 is an enlarged view of the main part of a piston.

On the outer circumferential surface of the piston 4, an annular recess is defined except the portion of an annular projection 41. In the annular recess 44 partly spaced apart by the annular projection 41, piston packings 5, 5 of Y-shape in section are disposed with its opening in face-to-face arrangement, whereby a storage reservoir B for storing a lubricant e.g. grease is formed. The details of which are shown in FIG. 5.

By providing the reservoir B of the abovementioned structure on the outer circumferential surface of the piston, the following effects are obtained:

When the piston 4 slides in the cylinder chamber 4 by means of pressurized air, the portion in slidable contact with the cylinder tube of the Y-sectioned piston packing 5 on the side of the air inlet is urged in the radial direction. As the result of this urging of the packing 5, the lubricant in the storage reservoir B is fed onto the sliding surface at every sliding movement, thus achieving excellent lubricating effect. Therefore excellent sliding movement is effected between the cylinder tube and the piston packings 5, 5, to improved their wear-resisting property.

When the piston 4 slides, the Y-sectioned piston packing 5 turned away from the air inlet is urged radially outwardly by means of air flowed into the reservoir B, thereby promoting sealing effect during the sliding movement of the piston.

Since the openings of the Y-sectioned piston packings 5, 5 are disposed opposite to each other, lubricant in the reservoir is prevented from flowing out wastefully.

Numeral 6 indicates a metallic piston rod comprising a larger diametered portion 60 and a small diametered portion 61 connected stepwise with said larger diametered portion 61. On the reduced portion 61, the piston 4 is mounted.

In FIGS. 1 and 2, the piston 4 is interposed between two keep plates 7, 7 and supported thereby onto the reduced portion 61 of the rod 6.

Figure 4:
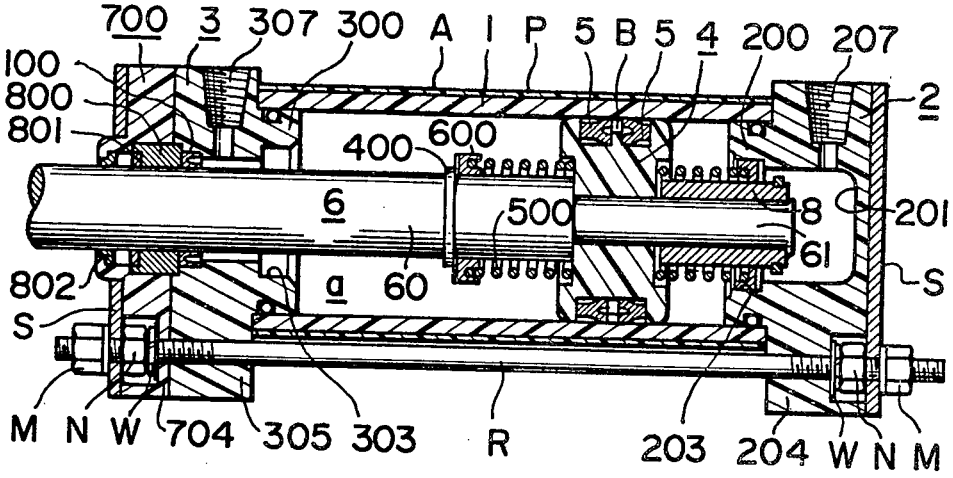
FIG. 4 is a transverse sectional view taken along the line X—X in FIG. 3.

Further, in FIG. 4, the piston 4 is fixedly mounted on the reduced portion 61 of the rod 6 in an interposed manner between and by means of a cylindrical nut 8 threadedly mounted on the reduced portion 61 of the rod 6 and the stepped portion of the rod 6. The outer diameter of the cylindrical nut 8 threadedly mounted on the reduced portion 61 is selected to be the same as that of the expanded portion 60 of the rod 6.

In the head cover 2 forming the body A, there is provided an air inlet 20, one end of which is communicated with a cylindrical recess 21 which is provided in the center of the head cover and opens on the side of the cylinder tube, while the other end is communicated through a flow controlling valve (not shown) with a change-over valve (not shown).

Further, a projecting portion 22 is integrally molded with the end portion of the head cover 2 so that a threaded portion 23 is provided on the circumference of the projecting portion for mounting a metal fitting e.g. a clevis for fixing the cylinder.

On the other hand, a projecting portion 30 is integrally molded with the end portion of the rod cover 3 constituting the cylinder body A in such a manner that a threaded portion 31 is provided on the circumferential surface of the projecting portion 30 for mounting a metal fitting e.g. a clevis for the fixing the cylinder.

Further, in the center of the rod cover 3, there is provided a through hole 32, through which the piston rod 6 passes. The said through hole 32 is connected to a hole 33 extending its diameter with a step in the direction toward the projecting portion 30. The said through hole 32 serves not only as a hole for passing the piston rod 6 but as a bearing for supporting the piston rod 6.

Further, in the rod cover 3 there is provided an air port 34 for taking in and exhausting air, one end of which is communicated with the through hole 32 provided in the center portion of the rod cover, while the other end is communicated through a flow controlling valve (not shown) with a change-over valve body (not shown).

Numeral 35 indicates a communicating duct which is communicated at its one end with the air port 34 in the rod cover and at its other end with the chamber in the cylinder tube 1.

Namely, since the through hole 32 serves also as a bearing for supporting the piston rod 6, a small space is formed between the through hole 32 and the piston rod passing therethrough, and therefore, air is flowed in and out through the communicating hole 35.

The cylinder tube 1 and the head cover 2 or the rod cover of the abovementioned construction are integrally molded, and on the other end of the cylinder tube 1 the rod cover 1 on the head cover 2 is threadedly fixed, whereby the cylinder body A is obtained.

At this stage, a sealing ring 9 of elastic rubber material is interposed between the cylinder tube 1 and the cover threadedly fixed to the tube 1. The sealing ring 9 serves to provide a seal between the tube 1 and the cover and also serves as a cushioning ring for avoiding the shock of the piston 4 when it comes into contact with the cover at the stroke end thereof.

Further, for obtaining a similar effect to that of the cushioning ring, a cushioning pad 10 formed from elastic rubber material is mounted on the reduced section 61 of the piston rod 6 so as to contact with one planar surface of the piston 4 i.e. the surface on the side of the cover molded integrally with the cylinder tube.

Numeral 11 indicates a rod packing disposed in the hole in continuation with the hole 33 and having an extended diameter, while numeral 12 indicates a packing gland disposed on the back face of the rod packing 11. Further, numeral 13 indicates a dust seal and numeral 14, a seal stopper.

Figure 3:
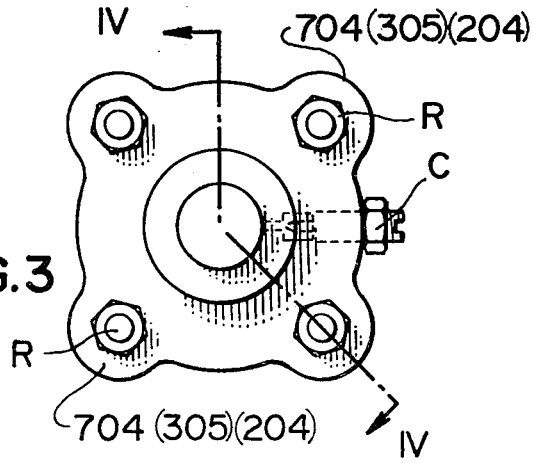
FIG. 3 is a fornt view of another preferred embodiment of a plastic air cylinder assembly according to the present invention.
Figure 6:
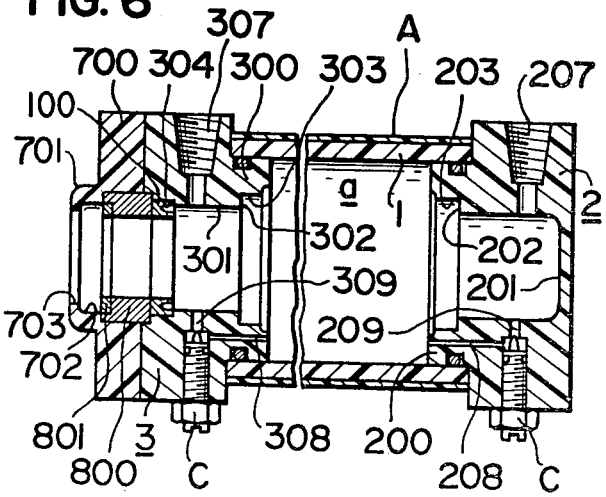
FIG. 6 is an enlarged view of the main part of a cushioning effect adjusting valve.

Referring now to FIGS. 3, 4 and 6 which show another preferred embodiment of the invention, in which the cylinder tube 1, the head cover 2 and the rod cover 3 are separately molded and then they are assembled by tightly fixing by means of a tie rod.

In the drawing, on one end of the head cover 2, a projecting portion 200 is provided, which is to be slidably fitted into the cylinder tube 1. And on the central portion of the projecting portion 200, a cylindrical recess 201 is formed so as to be in continuation with an annular recess 203 which has extended diameter with a step portion 202 and to open toward the projecting portion 200. The annular recess 203 serves as a recess in which a cushion packing for a belowmentioned cushioning mechanism is fitted.

On the outer circumferential surface of the head cover 2, there are provided lugs 204, 204 . . . . In the lug, a recess 205 directed toward the projecting portion 200 of the head cover. In the center of the bottom surface of the recess, a through hole 206 is provided. This through hole 206 serves as a hole through which a tie rod is passed on assembling the cylinder as belowmentioned.

Further, an air port 207 is provided in the head cover 2. One end of the air port 207 opens into the cylindrical recess 201 in the head cover 2 comunicated with the cylinder chamber a, while the other end is communicated through a separate flow controlling valve (not shown) with a change-over valve means (not shown).

Numeral 208 indicates a thin hole provided along the cylindrical recess 201 in the head cover 2. One end of the thin hole 208 opens into the cylinder chamber a, while the other end is communicated with a communicating hole 209 provided rectangularly of the thin hole 208 and opens into the cylindrical recess 201 of the head cover 2. The flow quantity of air from the thin hole 208 to the cylindrical recess 201 is controlled by a cushion controlling valve C provided at the communicating hole 209.

On the other hand, on one end of the rod cover 3, which constitutes the cylinder body A with the cylinder tube 1 and the head cover 2, there is provided a projecting portion 300 adapted to be slidably fitted into the cylinder tube. The projecting portion 300 is provided at its central protion with a through hole 301 which is in continuation with the annular recess 203 extending its diameter on the side of the projecting portion 300 of the cover with a step 302 and opens in the projecting portion 300.

Further, the through hole 301 is in continuation with the annular recess 304 on the side turned away from the projecting portion 300 of the cover, said annular recess 304 extending its diameter with a step so as to fit a seal packing 100 and also opening with a step at the other end.

The through hole 301 serves as a hole through which the piston rod 6 passes and air flows. The annular recess 303 formed in continuation with the through hole 301 serves as a recess into which a cushion packing of a cushioning mechanism is fitted, similarly to the annular recess 203 provided in the head cover.

On the outer circumferential sruface of the rod cover 3, there are provided lugs 305, 305 . . . , each lug having a through hole 306. Through the through hole 306, a tie rod is passed on assembling the cylinder as belowmentioned.

Further, the rod cover 3 is provided with an air port 307 one end of which opens into the central through hole 301 communicated with the cylinder chamber while the other end is communicated through a flow controlling valve (not shown) with a change-over valve means (not shown).

Numeral 308 indicates a thin hole provided along the through hole 301 in the central portion of the projecting portion 300 of the rod cover. One end of the thin hole opens into the cylinder chamber a while the other end is communicated with a communicating hole 309 provided perpendicularly to the thin hole 308 to open into the central through hole 301.

The flow quantity of air from the thin hole 308 to the central through hole 301 is controlled by means of a cushion controlling valve C provided at the communicating hole 309.

By the arrangement of the head cover 2 and the rod cover 3 of the abovementioned structure with the cylinder tube 1, the cylinder body is formed. The detail is shown in FIG. 6.

Now, the cushioning mechanism is described which is to be placed inside the cylinder body A.

An abovementioned, the piston rod 6 is fixed to the piston 4 which is to be arranged in the cylinder chamber a of the cylinder body A. And two cylindrical nuts 8, 8 are threadedly secured to the expanded section 60 and the reduced section 61 respectively of the piston rod 6 in a predeterminedly spaced and opposed manner with the interposition of the piston 4. Further, stop rings 400, 400 are fixed to the cylindrical nuts, respectively.

Cushion packings 600, 600 are disposed on the expanded section 60 of the rod and the outer circumferential surface of the cylindrical nut 8. The back face of each of the piston packings is urged against each of the stop rings 400, 400 by each spring 500, one end of which is disposed against the piston 4. The cushion packings 600, 600 are displaced according to the sliding movement of the piston 4, and sealedly fitted into the abovementioned annular recesses 203, 204 provided in the head cover 2 and the rod cover 3 before the piston reaches its stroke end.

Cushion packings 600, 600 are fitted into the annular recess 203, 303, they are brought in contact with the inner bottom surface of the recesses 203, 303 and slidably moved on the outer surface of the expanded section 60 of the rod and the cylindrical nut 8 through the extension and contraction of the springs 500, 500.

The cushioning mechanism of the abovementioned structure functions as follows.

Flowing in of compressed air through the air port 307 of the rod cover 3 causes the piston 4 to be slidably displaced toward the head cover 2.

The displacement of the piston 4 in turn causes air in the cylinder chamber to be flowed out through the air port 207, but when the cushion packing 600 disposed on the cylindrical nut 8 is sealedly fitted into the annular recess 203 formed in continuation with the cylindrical recess 201, an air pressure chamber is defined by the piston 4 and the head cover 2. Further displacement of the piston 4 allows air in the pressure chamber to flow into the thin hole 208 in the projecting portion of the head cover, and then to flow out through the communicating hole 209 communicated with the thin hole 208, the cylindrical recess 201 and the air port 207.

The speed of the sliding movement of the piston 4 at the stroke end is controlled by suitably controlling the cushion controlling valve C.

The description above is relative to the case of the displacement of the piston 4 toward the head cover 2. And in case of the displacement of the piston 4 toward the rod cover 3, the rod cover has a similar cushioning effect due to its similar structure to that of the head cover 2.

Numeral 700 indicates a plastic rod cover stopper disposed behind the other end of the rod cover 3. The rod cover stopper 700 is provided with a projection 701 at the central portion of its surface turned away from its surface in contact with the rod cover 3.

The rod cover stopper 700 is further provided with a cylindrical recess 702 and in the central portion of the cylindrical recess 702, there is provided a hole 703 through which the piston rod 6 passes.

On the outer peripheral surface of the rod cover stopper 700, there are provided lugs 704, 704 . . . , each lug 704 having a recess 705 extending toward the rod cover 3, and at the central portion of the bottom of the recess 705 there is provided a through hole through which a tie rod is passed on assembling the cylinder.

Numeral 800 indicates a bearing disposed inside the inner circumferential surface of the rod cover stopper 700, while numeral 801 indicates a felt ring disposed against the end face of the bearing 800, and 802 indicates a dust-proof seal disposed at the end of the cylindrical recess 702 of the rod cover stopper 700.

Designations S, S indicate supporting plates disposed behind the head cover 2 and the rod cover stopper 700.

The operation is now described for assembling a cylinder comprising the cylinder tube 1, the head cover 2, the rod cover 3 and the rod cover stopper 700.

Figure 7:
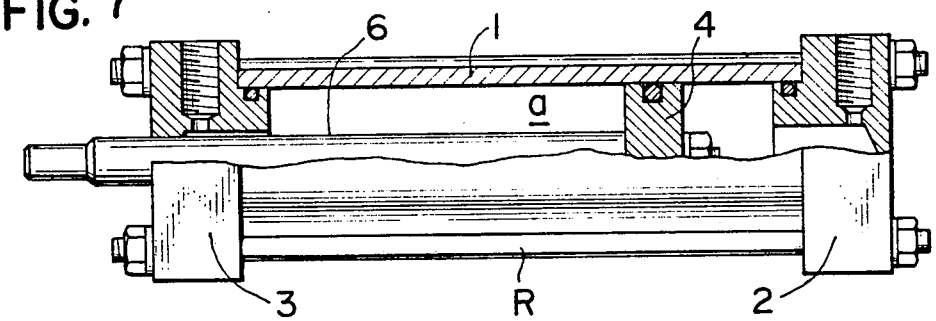
FIG. 7 is a transverse sectional view of a plastic air cylinder assembly of the prior art.
Figure 8:
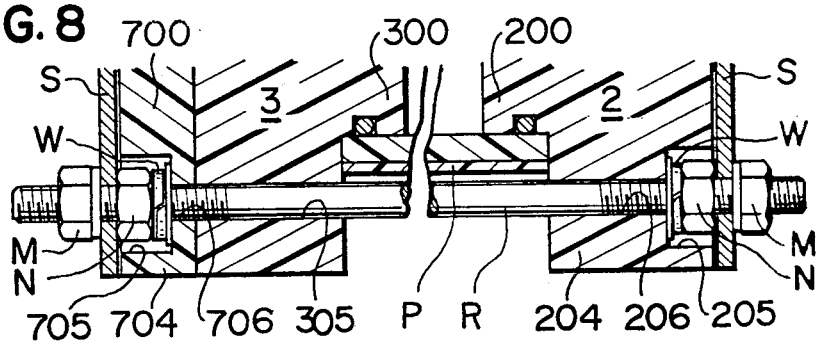
FIG. 8 is an enlarged view of a tightly-fixing part of the cylinder assembly of FIG. 4.

In FIG. 7, there are illustrated a conventional metal cylinder assembled with a tie rod. In FIG. 8, the details of the assembling operation with a tie rod according to the present invention is described.

Referring to FIG. 8, the head cover 2 is disposed at one end of the cylinder tube 1, and the rod cover at the other end thereof. The rod cover stopper 700 is disposed behind the rod cover 3. The lugs 204, 305, 704 on the outer circumferential surfaces of the head cover, the rod cover and the rod cover stopper are aligned and the tie rod R is passed through the through holes 206, 306, 706 provided in the lugs.

In the recesses 205 and 705 provided in the lug 204 on the outer circumferential surface of the head cover 2 and in the lug 305 on the outer circumferential surface of the rod cover stopper 700, the cylinder tube 1, the head cover 2, the rod cover 3 and the rod cover stopper 700 are tightened by nuts N, N threadedly mounted on the tie rod R with the interposition of washers W, W.

At this stage, tightening with the nuts N, N is performed to such an extent that the cutaway portions of the spring washers are not conformed. And the surface of the nuts N, N turned away from the contact surface with the spring washers W, W are disposed so as to a little protrude beyond the end faces of the head cover 2 and the rod cover stopper 700. This is for the purpose that when the cylinder tube thermally expands or contracts longitudinally, they are allowed to expand or contract freely by the spring effect of the spring washers W, W.

After assembling as abovementioned, supporting plates S, S are disposed on contact with the nuts N, N protruded a little beyond the head cover 2 and the rod cover stopper 700, but not in contact with the end surfaces of the head cover 2 and the rod cover stopper 700, and then nuts M, M are threadedly mounted on the tie rod R and firmly tightened.

This tightening force acts as pressing force only on the supporting plates S, S disposed between the nuts N, N and M, M. In other words, the tightening force of the nuts M, M applies tension only on the part of the tie rod between the nuts M, M and N, N and has no influence on the part of the tie rod between the head cover 2 and the rod cover 3 to which tension is applied only at the primary tightening.

By adopting such a tightening method with the tie rod, defects such as air leakage and low working efficiency due to the difference between the coefficients of thermal expansion and contraction can be completely eliminated.

As described above in detail, the connecting means of the invention for tightly and resiliently connecting the head cover and the rod cover includes a plurality of metal tie rods R passing through the through-holes of the lugs of the head cover 2 and the rod cover 3, an inside nut N in each of the recesses in the lugs threadedly engaged with one of the tie rods, a resilient and compressible member W, W in each of the recesses in the lugs 204 interposed between each of the inside nuts N, N and the lug, each of the resilient and compressible members W, W being only partially compressed by the associated inside nut, each inside nut projecting outwardly slightly from the associated recess beyond the outer surface of the associated cover, a first supporting plate S opposed to the outer surface of the head cover and engaging the inside nuts in the recesses of the head cover and being spaced from the outer surface of the head cover by the inside nuts, a second supporting plate S opposed to the outer surface of the rod cover and engaging the inside nuts in the recesses of the rod cover and being spaced from the outer surface of the rod cover by the inside nuts, said tie rods extending through openings in said first and second support plates, and outside nuts threadedly engaged with each end of each tie rod, the outside nuts forcing the first and second supporting plates against the inside nuts whereby the plastic cylinder tube 1 is permitted to expand more than the metal tie rods R by further compressing the resilient and compressible members W, W.

Lastly, broken pieces produced by the explosion of the cylinder tube 1 is prevented from flying apart in the following manner.

In FIG. 4, the protective layer P on the outer circumferential surface of the cylinder tube 1 contributes to the prevention of flying apart of the fragments of the broken cylinder tube at explosion.

Flying apart of the fragments of the broken cylinder tube is prevented in different maner depending upon the inner diameter of the cylinder tube. That is, this purpose is achieved by increasing the thickness of the cylinder tube when the inner diameter is small as shown in FIGS. 1 and 2, but by providing a plastic protective layer P on the outer circumferential surface of the cylinder tube when the inner diameter is large as shown in FIG. 4.

Plastic material for the protective layer is selected from thermoplastic synthetic resins having the extension percentage more than 100%, preferably more than 150%, e.g. polyethylene resin, polypropylene resin, polyamido resin and non-rigid vinyl chloride resin.

The process for providing a plastic protective layer P on the circumferential surface of the cylinder tube 1 comprises preliminarily forming the protective layer in a tubular shape and then fitting the same on the outer circumferential surface of the tube, integrally molding the layer on the outer circumferential surface of the cylinder tube, or other suitable process.

Impact tests were performed using some combinations of the abovementioned plastic materials under the following conditions and the breaking up of the cylinder tube was observed.

Test conditions

1. Dimension of the cylinder tube:
   inner diameter 50 mm
   outer diameter 60 mm
2. Internal pressure: 10 kg/cm$^2$
3. Impact load: 1 kg weight of a weight was dropped from 1 m above the cylinder
4. The protective layer was integrally molded on the outer circumferential surface of the cylinder tube so as to have 2 mm thickness.

The result of the tests using a variety of combinations of plastic materials are shown in the following table.

TABLE

| Material for cylinder tube | Material for protective layer | Extension percentage of cylinder tube (%) | Extension percentage of protective layer (%) | Condition of cylinder tube at explosion |
|---|---|---|---|---|
| Polyacetal | — | 60 | — | |
| Poly-carbonate | — | 80 | — | Fragments of broken cylinder tube fly apart |
| Oleo- | — | 40 | — | |

TABLE-continued

| Material for cylinder tube | Material for protective layer | Extension percentage of cylinder tube (%) | Extension percentage of protective layer (%) | Condition of cylinder tube at explosion |
|---|---|---|---|---|
| polyacetal | | | | |
| | Poly-ethylene (A) | 60 | 90 | Fragments fly apart |
| | Poly-ethylene (B) | | 100 | Cylinder tube as broken but fragments didn't fly apart due to protective layer |
| | Poly-ethylene (C) | | 150 | |
| Poly-carbonate | | | | |
| | Poly-propylene | 60 | 300 | |
| | Pol,amide | | 220 | Protective layer was cracked at its loaded point. |
| | Non-rigid vinyl chloride | | 300 | |
| | Poly-ethylene (A) | 40 | 90 | Fragments fly apart with denotation |
| | Poly-ethylene (B) | | 100 | Cylinder tube was broken but fragments didn't fly apart due to protective layer |
| Oleo-polyacetal | Poly-ethylene (C) | | 150 | |
| | Poly-propylene | 40 | 300 | Protective layer was cracked at its loaded point. |
| | Polyamide | | 220 | |
| | Non-rigid polyvinyl chlordie | | 300 | |

As apparent from the test result shown in the Table, cylinder tubes formed form polyacetal resin, polycarbonate resin or oleo-polyacetal resin were broken and the fragments flew around with a detonation when an accidental impact load was applied thereon during operation, since these resins have a low extension percentage.

On the other hand, cylinder tubes provided on the outer circumferential surface with a plastic protective layer of extension ratio more than 100% were only cracked on the said protective layer under an accidental impact load during operation and no fragments flew apart, whereby the purpose of prevention of flying apart of fragments was achieved.

The effect of prevention of flying apart of fragments by the protective layer formed from thermoplastic resin changes at the boundary of 100% extension percentage of the resin. In case of a thermoplastic resin of extension percentage below 100%, flying apart of fragments under an impact load is restrained in comparison with the case of a cylinder tube without the provision of a protective layer, but this effect was not satisfactory.

As apparently shown in the abovementioned description of the preferred embodiments of the present invention, a series of improvements according to the present invention can remarkably develop the usefulness of a plastic air cylinder assembly.

What is claimed is:

1. In an air cylinder assembly including a plastic cylinder tube, a plastic head cover mounted on one end of said cylinder tube and provided with a plurality of lugs each having a through-hole, a plastic rod cover mounted on the other end of said cylinder tube and provided with a plurality of lugs each having a through-hole aligned with a through-hole of said head cover, each of said two covers having inner and outer surfaces and the outer surfaces of each lug of said two covers having a radially enlarged recess for receiving a nut at its through-hole, a plastic piston slidable within said cylinder tube, and a piston rod connected to the piston and passing through an aperture of said rod cover; the improvement comprising: connecting means for tightly and resiliently connecting the head cover and the rod cover, the connecting means including a plurality of metal tie rods passing through the through-holes of said lugs of said head cover and said rod cover, an inside nut in each of said recesses in said lugs threadedly engaged with one of the tie rods, a resilient and compressible member in each of said recesses in said lugs interposed between each of said inside nuts and the lug, each of said resilient and compressible members being only partially compressed by the associated inside nut, each inside nut projecting outwardly slightly from the associated recess beyond the outer surface of the associated cover, a first supporting plate opposed to the outer surface of said head cover and engaging the inside nuts in the recesses of said head cover and being spaced from the outer surface of the head cover by the inside nuts, a second supporting plate opposed to the outer surface of said rod cover and engaging the inside nuts in the recesses of said rod cover and being spaced from the outer surface of the rod cover by the inside nuts, said tie rods extending through openings in said first and second support plates, and outside nuts threadedly engaged with each end of each tie rod, the outside nuts forcing the first and second supporting plates against said inside nuts whereby said plastic cylinder tube is permitted to expand more than said metal tie rods by further compressing said resilient and compressible members.

2. In an air cylinder assembly including a plastic cylinder tube formed from a plastic material selected from a group consisting of polyacetal resin, polycarbonate resin, lubricating oil containing polyacetal resin, and lubricating oil containing polycarbonate resin, a plastic head cover mounted on one end of said cylinder tube and provided with a plurality of lugs each having a through-hole, a plastic rod cover mounted on the other end of said cylinder tube and provided with a plurality of lugs each having a through-hole aligned with a through-hole of said head cover, each of said two covers having inner and outer surfaces and the outer surfaces of each lug of said two covers having a radially enlarged recess for receiving a nut at its through-hole, a plastic piston slidable within said cylinder tube, and a piston rod connected to the piston and passing through an aperture of said rod cover; the improvement comprising: connecting means for tightly and resiliently connecting the head cover and the rod cover, the connecting means including a plurality of metallic tie rods passing through the through-holes of said lugs of said head cover and said rod cover, an inside nut in each of said recesses in said lugs threadedly engaged with one of the tie rods, a spring washer in each of said recesses in said lugs interposed between each of said inside nuts and the lug, each of said spring washers being only partially compressed by the associated inside nut, each inside nut projecting outwardly slightly from the associated recess beyond the outer surface of the associated cover, a first supporting plate opposed to the outer surface of said head cover and engaging the inside nuts in the recesses of said head cover and being spaced from the outer surface of the head cover by the inside nuts, a second supporting plate opposed to the outer surface of said rod cover and engaging the inside nuts in the recesses of said rod cover and being spaced from the outer surface of the rod cover by the inside nuts, said tie rods extending through openings in said first and second support plates, and outside nuts threadedly engaged with each end of each tie rod, the outside nuts forcing the first and second supporting plates against said inside nuts whereby said plastic cylinder tube is permitted to expand more than said metal tie rods by further compressing said spring washers.

3. The assembly of claim 2 including a protective layer on the outer circumferential surface of said cylinder tube, said protective layer being formed from a thermoplastic material of extension percentage more than 100% and selected from the group consisting of polyethylene, polyamide, polypropylene and non-rigid vinyl chloride.

4. The assembly of claim 2 including a pair of Y-sectioned piston packings received in an annular recess in the outer circumferential surface of said piston on opposite sides of an annular projection formed in the center of the annular recess and sealingly engaging the cylinder tube, and Y-sectioned packings having openings facing each other and defining a lubricant reservoir.

5. The assembly of claim 3 including a pair of Y-sectioned piston packings received in an annular recess in the outer circumferential surface of said piston on opposite sides of an annular projection formed in the center of the annular recess and sealingly engaging the cylinder tube, the Y-sectioned packings having openings facing each other and defining a lubricant reservoir.

6. The assembly of claim 5 in which between said rod cover and each corresponding washer is disposed a rod cover stopper provided with a recess for receiving said inside nut.

* * * * *